US010556460B2

(12) United States Patent
Malinverni et al.

(10) Patent No.: US 10,556,460 B2
(45) Date of Patent: Feb. 11, 2020

(54) WRITING INSTRUMENT WITH SELF-BLOCKING ASSEMBLY

(71) Applicant: SOCIETE BIC, Clichy (FR)

(72) Inventors: Samuel Malinverni, Paris (FR); Arnaud Bez, Garches (FR)

(73) Assignee: SOCIETE BIC, Clichy (FR)

( * ) Notice: Subject to any disclaimer, the term of this patent is extended or adjusted under 35 U.S.C. 154(b) by 0 days.

(21) Appl. No.: 16/076,591

(22) PCT Filed: Feb. 8, 2017

(86) PCT No.: PCT/FR2017/050281

§ 371 (c)(1),
(2) Date: Aug. 8, 2018

(87) PCT Pub. No.: WO2017/137696

PCT Pub. Date: Aug. 17, 2017

(65) Prior Publication Data

US 2019/0047319 A1 Feb. 14, 2019

(30) Foreign Application Priority Data

Feb. 11, 2016 (FR) ..... 16 51103

(51) Int. Cl.
*B43K 7/12* (2006.01)
*B43K 24/04* (2006.01)
(Continued)

(52) U.S. Cl.
CPC ..... *B43K 7/12* (2013.01); *B43K 5/005* (2013.01); *B43K 24/04* (2013.01); *B43K 24/082* (2013.01); *B43K 29/02* (2013.01); *B43K 7/005* (2013.01)

(58) Field of Classification Search
CPC ..... B43K 7/12; B43K 24/04; B43K 25/028; B43K 7/005; B43K 5/005; B43K 24/02;
(Continued)

(56) References Cited

U.S. PATENT DOCUMENTS 4,529,328 A * 7/1985 Wacha ..... B43K 7/005 401/116
7,461,989 B1 12/2008 Dickover et al.
(Continued)

FOREIGN PATENT DOCUMENTS

EP 2 351 652 A1 8/2011
FR 1379338 A 11/1964
(Continued)

OTHER PUBLICATIONS

International Search Report dated May 22, 2017 from corresponding International Patent Application No. PCT/FR2017/050281, 8 pages.
(Continued)

*Primary Examiner* — David J Walczak
(74) *Attorney, Agent, or Firm* — Ohlandt, Greeley, Ruggiero & Perle, L.L.P.

(57) ABSTRACT

The writing instrument comprises a first barrel, a second barrel, and a self-blocking assembly system for assembling the first barrel with the second barrel. The self-blocking assembly system includes a blocking device for blocking the first barrel with respect to the second barrel in a longitudinal direction and a locking device for locking the blocking device. The locking device includes a slot formed in the first barrel and two ramps carried by the second barrel. The slot extends in the longitudinal direction and has two longitudinal edges. The two ramps are configured to part the two longitudinal edges of the slot progressively in a circumferential direction as the first and second barrels are assembled. A window extends in the longitudinal direction formed between the two ramps, and a lateral button is housed at least partially in the window that includes guide surfaces for guiding the lateral button.

6 Claims, 4 Drawing Sheets

(51) Int. Cl.

| | |
|---|---|
| ***B43K 24/08*** | (2006.01) |
| ***B43K 7/00*** | (2006.01) |
| ***B43K 5/00*** | (2006.01) |
| ***B43K 29/02*** | (2006.01) |

(58) Field of Classification Search
CPC ..... B43K 24/026; B43K 24/08; B43K 24/08224; B43K 24/12; B43K 24/26
See application file for complete search history.

(56) References Cited

U.S. PATENT DOCUMENTS

| | | | |
|---|---|---|---|
| 2001/0053307 | A1 | 12/2001 | Rigoni |
| 2006/0216103 | A1 | 9/2006 | Bielecki et al. |
| 2008/0260453 | A1 | 10/2008 | Kageyama |
| 2014/0072359 | A1 | 3/2014 | Boisdevesys |

FOREIGN PATENT DOCUMENTS

| | | | |
|---|---|---|---|
| JP | 8-85292 | H | 4/1996 |
| JP | 2000079788 | A | 3/2000 |
| JP | 2002172887 | A | 6/2002 |
| JP | 2004148760 | A | 5/2004 |
| JP | 2004202810 | A | 7/2004 |
| JP | 2005081743 | A | 3/2005 |
| JP | 2015030164 | A | 2/2015 |
| WO | 2005/092637 | A2 | 10/2005 |

OTHER PUBLICATIONS

Written Opinion dated May 22, 2017 from corresponding International Patent Application No. PCT/FR2017/050281, 6 pages.

* cited by examiner

WRITING INSTRUMENT WITH SELF-BLOCKING ASSEMBLY

BACKGROUND

The present disclosure relates to a writing instrument, and in particular to a system for assembling together two barrels of the writing instrument.

By way of example, two barrels may be assembled together by screwing them together or by snap-fastening between ribs and grooves formed on or in each of the barrels.

Nevertheless, the two barrels can be separated from each other relatively easily. There thus exists a risk of the two barrels becoming separated when that is not desired, e.g. while in use.

SUMMARY

The present disclosure seeks to remedy those drawbacks, at least in part.

To this end, the present disclosure provides a writing instrument extending in a longitudinal direction and having a circumferential direction and a radial direction, the writing instrument comprising a first barrel, a second barrel, and a self-blocking assembly system for assembling together the first barrel and the second barrel, the self-blocking assembly system comprising a blocking device for blocking the first barrel relative to the second barrel in the longitudinal direction and a locking device for locking the blocking device.

Since the device for blocking the first barrel to the second barrel is locked by the locking device of the self-blocking assembly system while the first barrel is being assembled to the second barrel, it is relatively difficult to separate the two barrels. It is therefore improbable that the two barrels will become separated unintentionally.

It can be understood that the writing instrument may be of any type.

The blocking device may be deformed in the circumferential direction by the locking device.

The deformation in the circumferential direction of the blocking device makes it relatively difficult to deactivate the blocking device.

The blocking device may comprise at least one annular rib carried by the first barrel and at least one annular groove formed in the second barrel, or vice versa, the annular rib and the annular groove co-operating by engaging one in the other.

Co-operation by engagement between a rib and a groove belonging to respective ones of the two barrels is a simple way of making a blocking device.

The term "annular" designates a rib or a groove in the shape of a ring or of a portion of a ring.

The co-operation by engagement may be achieved by the annular rib and the annular groove being complementary in shape.

Furthermore, when the annular rib or the annular groove is deformed in the circumferential direction by the blocking device, the engagement between the rib and the groove is increased, thereby locking the blocking device.

The locking device may comprise a slot arranged in the first barrel and two ramps carried by the second barrel, the slot extending in the longitudinal direction and presenting two longitudinal edges, while the two ramps are configured to move the two longitudinal edges of the slot apart progressively in the circumferential direction during assembly of the first and second barrels.

It can be understood that the blocking device becomes locked at the end of assembling the two barrels together.

The two ramps may be configured to move the longitudinal edges of the slot apart progressively in the circumferential direction while the first and second barrels are being assembled together, whereby the annular rib is locked in position inside the annular groove.

The movement of assembling the two barrels together comprises the first barrel moving in translation relative to the second barrel, enabling the two barrels to be blocked relative to each other, and enabling the blocking device to be locked at the end of assembly. It is thus a single movement of the first barrel relative to the second barrel. The blocking device is locked at the end of the movement of the first barrel relative to the second barrel in a continuous movement of the first barrel relative to the second barrel.

A maximum space between the two ramps is greater than a maximum space between the two longitudinal edges of the slot prior to assembling the two barrels together, these spaces being measured in the circumferential direction. For example, the space in the circumferential direction between the two ramps increases or decreases on moving in the longitudinal direction between the two opposite longitudinal ends of the ramps.

A maximum thickness in the radial direction of the ramps may be greater than a thickness in the radial direction of an assembly end of the first barrel for assembly with the second barrel.

For example, the maximum thickness of the ramps may be not less than the thickness of the assembly end of the first barrel.

The writing instrument may include a window extending in the longitudinal direction and arranged between the two ramps, and also a side button received at least in part in the window, the window possibly including guide surfaces for guiding the side button.

The first barrel may be partially received in the second barrel and the ramps may project in the radial direction into the inside of the second barrel and be arranged between the longitudinal edges of the slot so as to move the longitudinal edges of the slot apart in the circumferential direction.

BRIEF DESCRIPTION OF THE DRAWINGS

Other characteristics and advantages of the invention appear from the following description of embodiments of the invention, given as non-limiting examples and with reference to the accompanying figures, in which.

DETAILED DESCRIPTION

Figure 1:
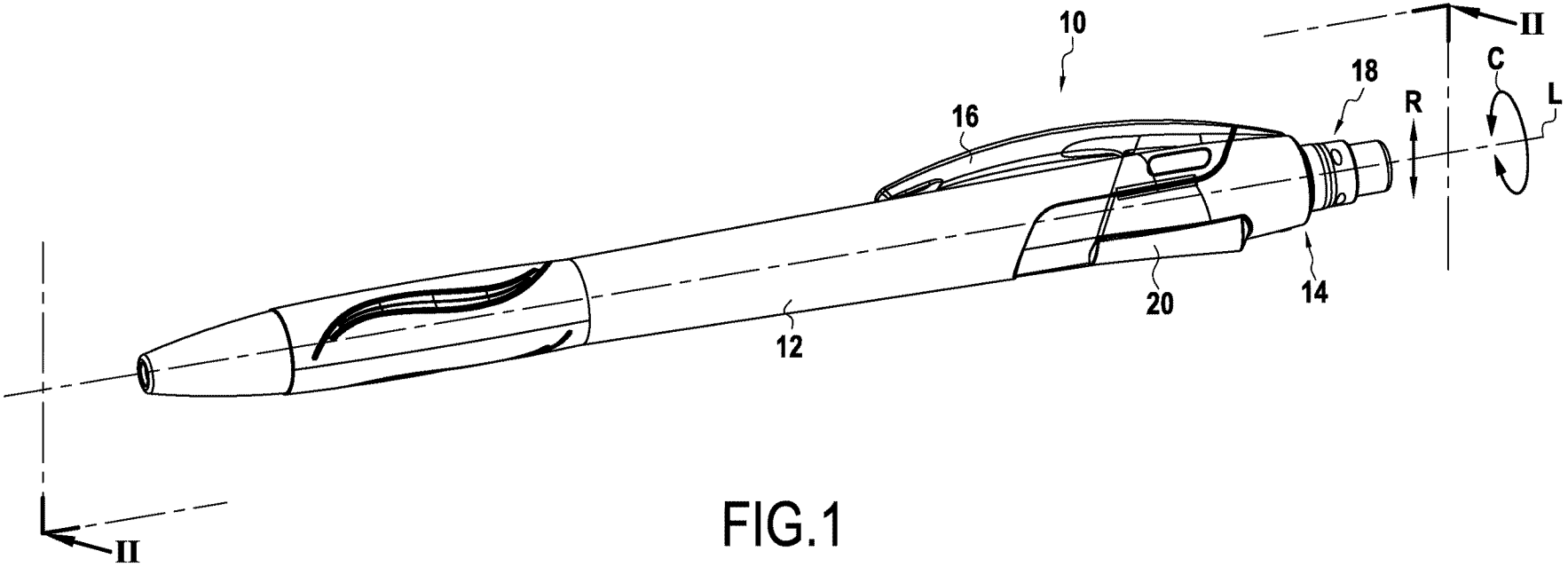
FIG. 1 is a perspective view of a writing instrument including a self-blocking assembly system.

FIG. 1 shows a writing instrument 10 extending in a longitudinal direction L and having a circumferential direction C and a radial direction R.

In general manner, the longitudinal direction corresponds to the direction of the axis L of the barrel, and the radial direction R is a direction perpendicular to the longitudinal direction L. The circumferential direction C corresponds to the direction that describes a ring around the longitudinal direction L. These three directions, longitudinal, radial, and circumferential (or azimuth) correspond respectively to the directions defined by the height, the radius, and the angle in a cylindrical coordinate system. Finally, unless specified to the contrary, the adjectives "inner" and "outer" are used with reference to a radial direction such that an inner portion (i.e. a radially inner portion) of an element is closer to the axis L than is an outer portion (i.e. a radially outer portion) of the same element.

In the embodiment shown in FIG. 1, the writing instrument 10 comprises a first barrel 12 and a second barrel 14. The second barrel 14 includes a clip 16 of the writing instrument 10 together with an eraser device 18. The writing instrument 10 also has a side button 20.

Figure 2:
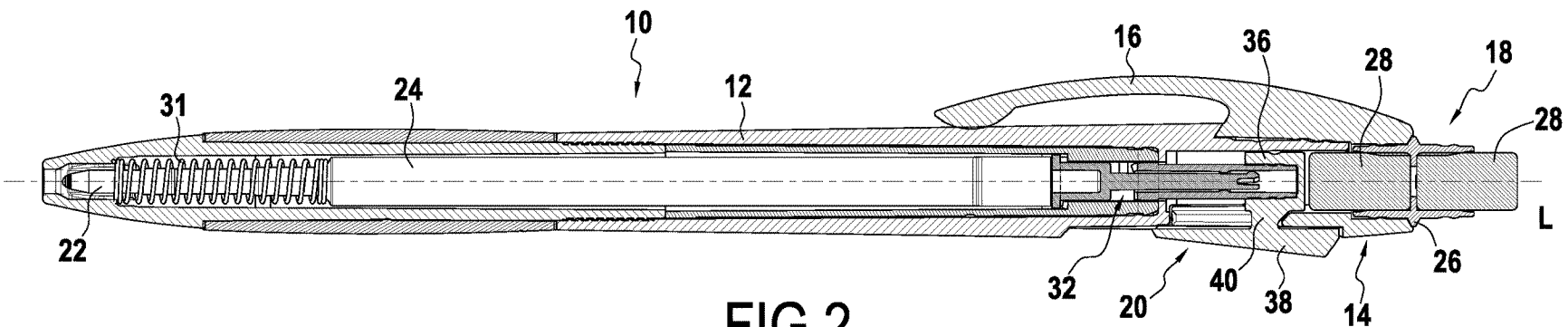
FIG. 2 is a section view of the FIG. 1 writing instrument on plane II-II.
Figure 3:
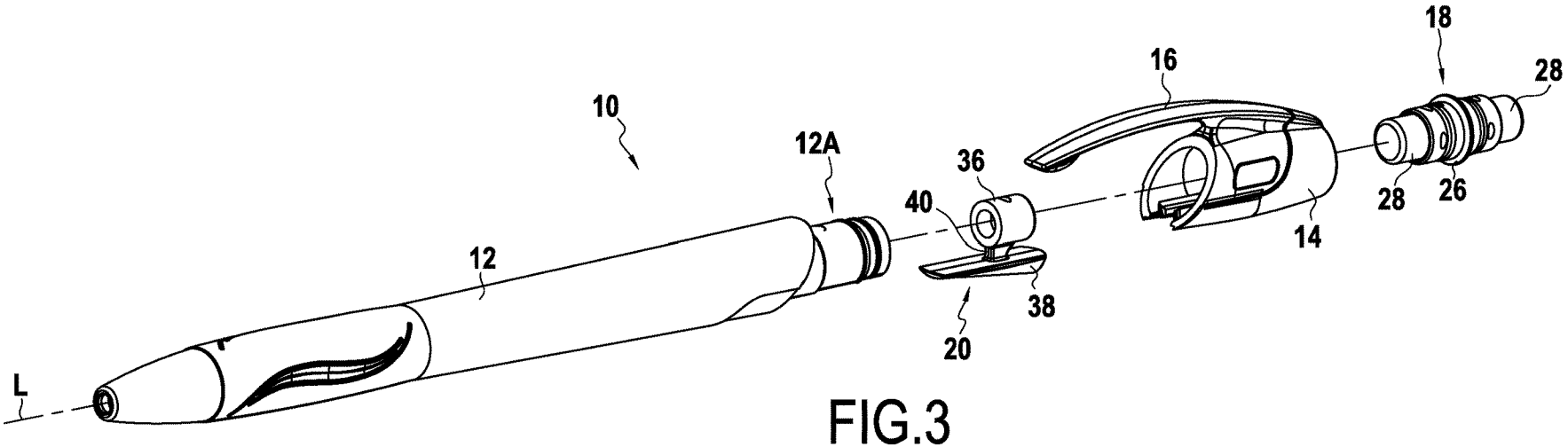
FIG. 3 is a partially exploded perspective view of the FIG. 1 writing instrument seen from a first viewpoint.
Figure 4:
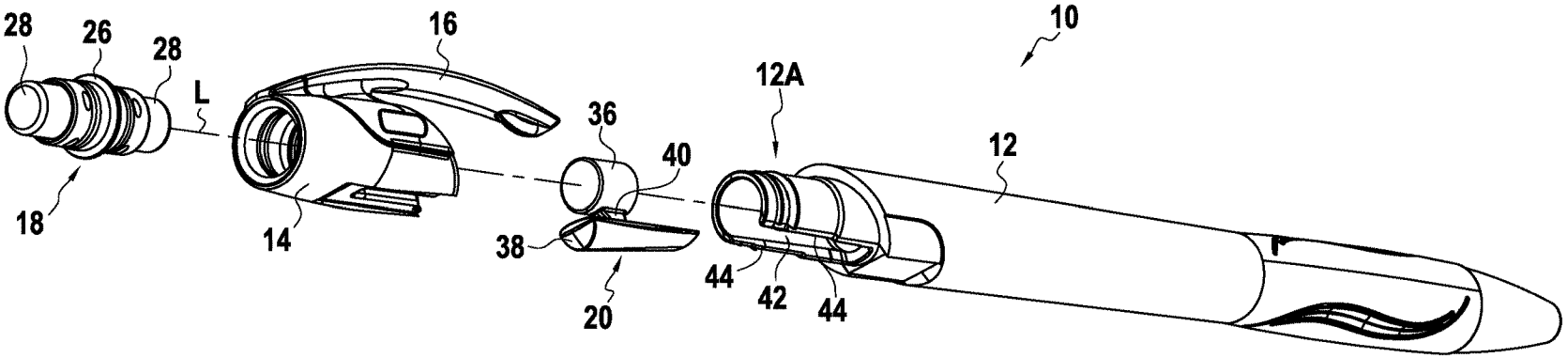
FIG. 4 is a partially exploded perspective view of the FIG. 1 writing instrument seen from a second viewpoint.

As shown in FIG. 2, the side button 20 slides in the longitudinal direction L to retract or to extend a writing tip 22.

In the embodiment described, the writing tip 22 is made integrally with a writing cartridge 24. It can be understood that the writing instrument 10 may be of any type and is not limited to the writing instrument 10 in which the writing tip 22 is made integrally with the writing cartridge 24.

In this example, the eraser device 18 comprises a reversible eraser support 26 that receives respective erasers 28 in each of its ends.

In conventional manner, the writing instrument has a nose screwed into the first barrel 12. The writing tip 22 and the writing cartridge 24 are received in the first barrel and in the nose. The writing instrument 10 also has an extender device 32 for extending the writing tip 22, which device co-operates with a spring 31 to enable the writing tip to be extended from and retracted into the nose 30 of the writing instrument 10.

The extender device 32 for extending the writing tip 22 is actuated by the side button 20, which is housed in part in the first and second barrels 12 and 14.

The side button comprises a reception portion 36 for receiving the extender device 32 and an actuator portion 38. The reception portion 36 is connected to the actuator portion 38 by a rod 40.

Figure 5:
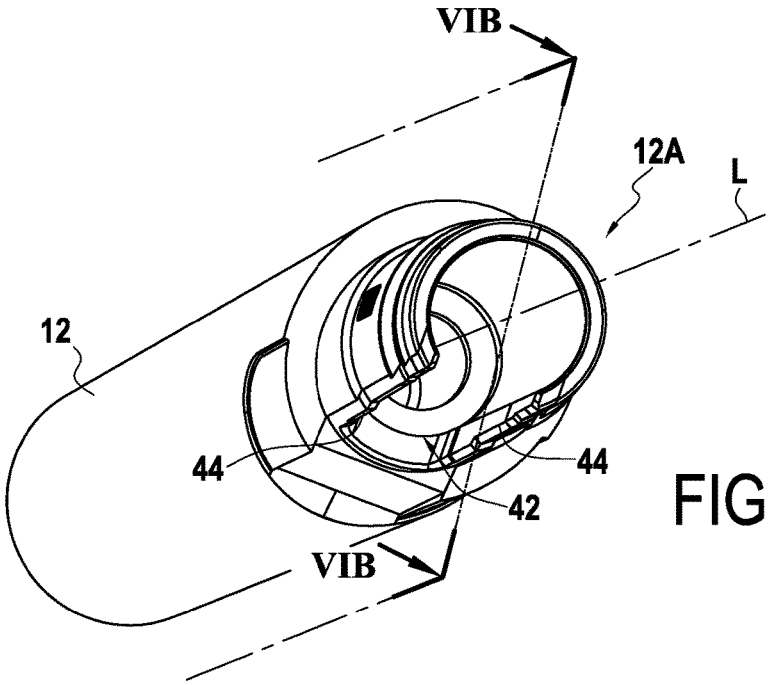
FIG. 5 is a perspective view of one end of the first barrel.
Figure 6A:
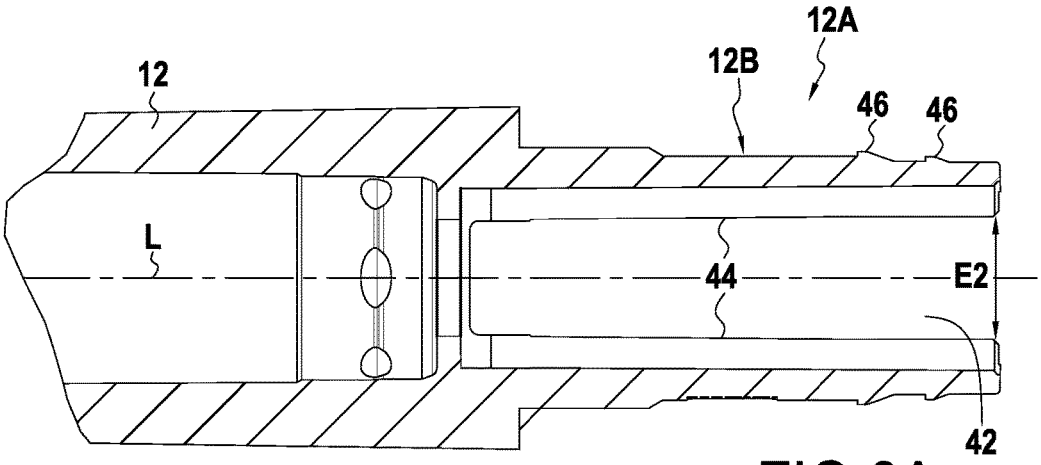
FIGS. 6A and 6B are fragmentary section views of the first barrel on planes VIA-VIA and VIB-VIB of FIGS. 5 and 6B.
Figure 6B:
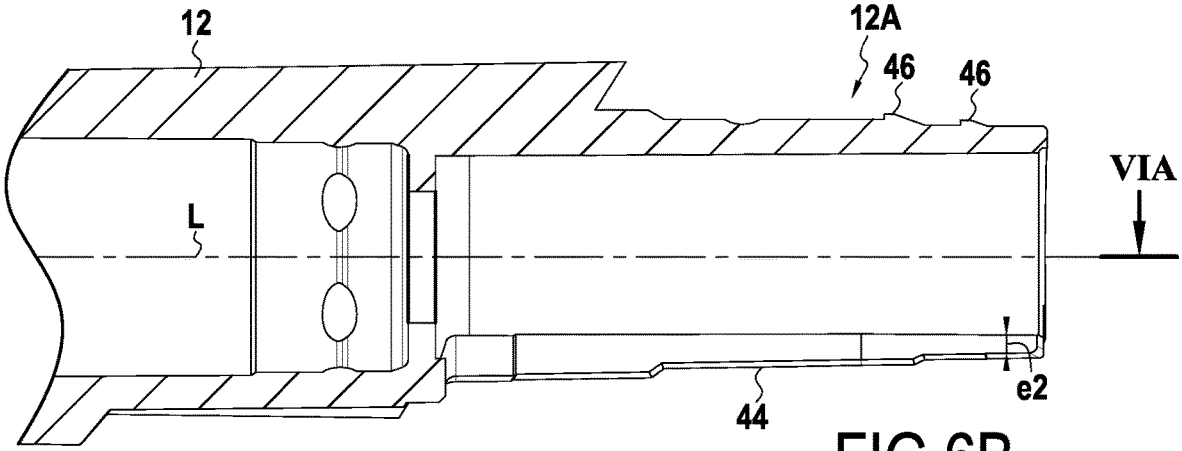

FIGS. 5, 6A, and 6B show an assembly end 12A of the first barrel. This assembly end 12A is generally cylindrical in shape and includes a slot 42 formed in the first barrel 12 and extending in the longitudinal direction L. The slot 42 has two longitudinal edges 44.

The assembly end 12A has an outer surface 12B with two annular ribs 46. The term "annular" is used of the ribs 46 even though they present the shape of only a portion of a ring.

Figure 7:
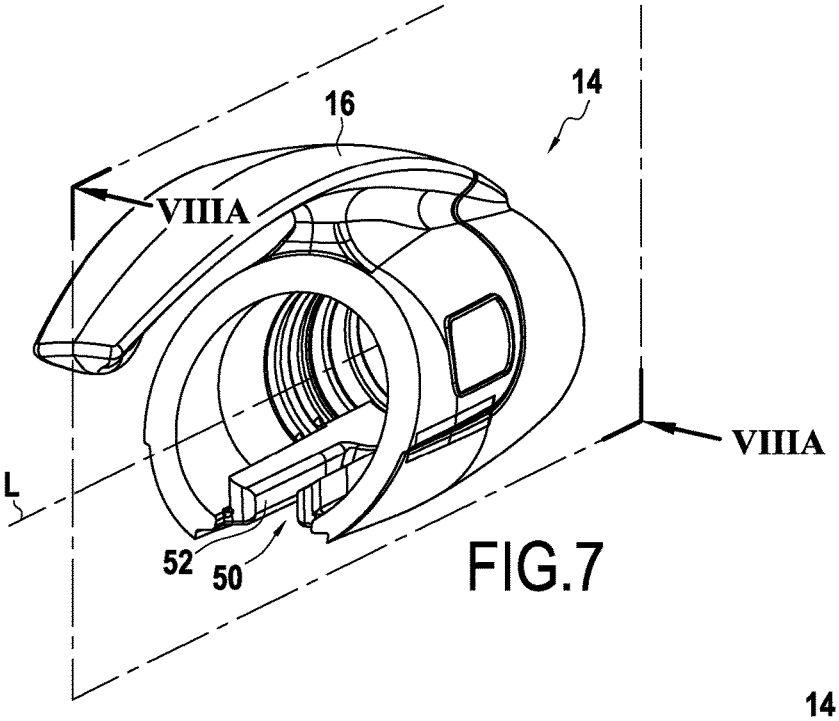
FIG. 7 is a perspective view of the second barrel.
Figure 8A:
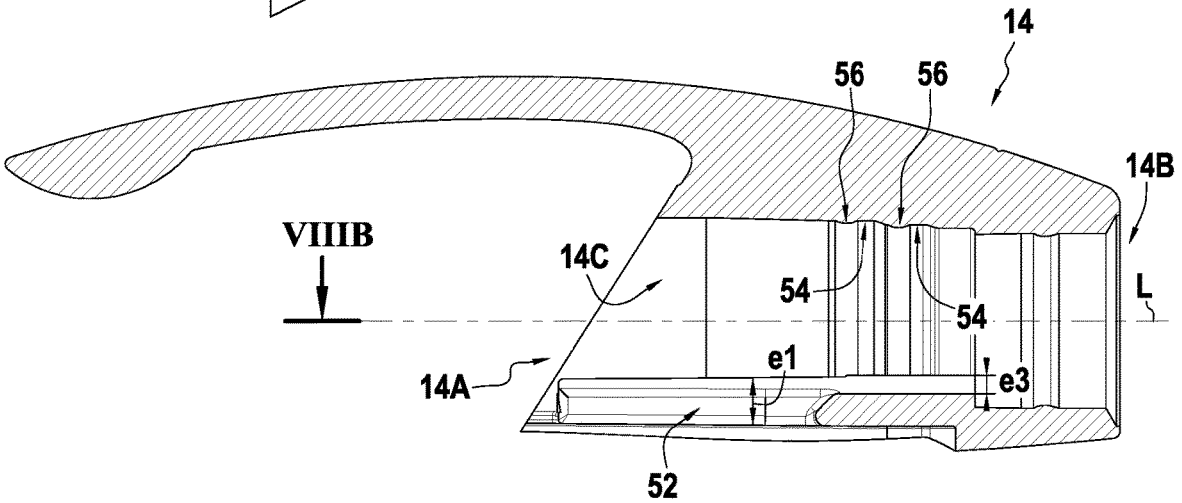
FIGS. 8A and 8B are section views of the second barrel on planes VIIIA-VIIIA and VIIIB-VIIIB of FIGS. 7 and 8A.
Figure 8B:
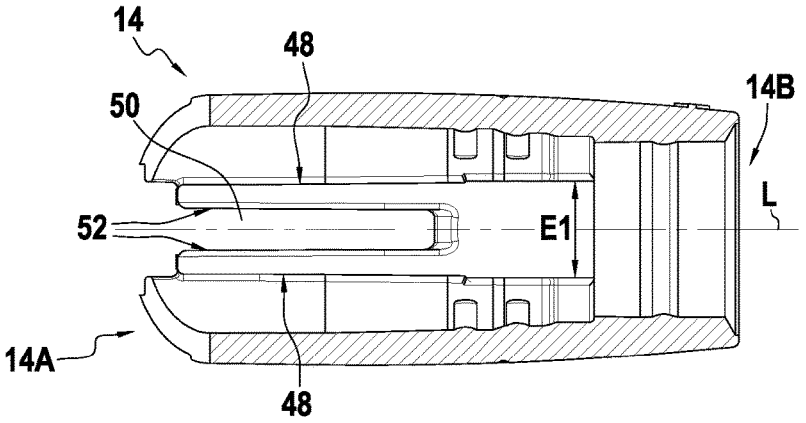

FIGS. 7, 8A, and 8B show the second barrel 14. The second barrel 14 has an assembly end 14A of the second barrel 14 that is configured to be assembled with the assembly end 12A of the first barrel 12, a reception end 14B for receiving the eraser device 18, and an inner surface 14C.

Beside the assembly end 14A of the second barrel, the second barrel 14 has two ramps 48 with a window 50 formed between them. The window 50 extends in the longitudinal direction L and includes at least two guide surfaces 52 for guiding the side button 20.

The two ramps 48 project in the radial direction R into the inside of the second barrel 14.

The inner surface 14A of the second barrel 14 forms two annular grooves 54 and two annular beads 56. Each annular bead 56 is arranged in front of a corresponding annular groove 54.

The ramps 48 are configured to move the longitudinal edges 44 of the slot 42 apart in the circumferential direction C progressively while the first barrel 12 is being assembled with the second barrel 14. For example, the space in the circumferential direction C between the two ramps 48 increases on going along the longitudinal direction L between the assembly end 14A and the reception end 14B of the second barrel 14. The space between the two ramps 48 may increase progressively or it may increase in the form of a step arranged between the longitudinal ends of the ramps 48.

It can be understood that in the non-assembled position, a maximum space E1 between the two ramps 48 is greater than a maximum space E2 between the two longitudinal edges 44 of the slot 42 before the two barrels 12 and 14 are assembled together, these spaces being measured along the circumferential direction C.

Furthermore, the ramps 48 present a maximum thickness e1 in the radial direction R that is greater than a thickness e2 in the radial direction R of the assembly end 12A of the first barrel 12.

It should also be observed that the ramps 48 present a minimum thickness e3 in the radial direction R that is not less than the thickness e2.

While the first barrel 12 is being assembled with the second barrel 14, the reception portion 36 of the side button 20 is inserted in the first barrel 12, the rod 40 of the side button 20 being arranged in the slot 42 in the first barrel 12. It is also possible to insert the reception portion 36 of the side button 20 in the second barrel 14, the rod 40 of the side button 20 being arranged in the window 50 of the second barrel 14. The side button 20 is thus received in part in the window 50.

Thereafter, the assembly end 12A of the first barrel 12 is inserted into the assembly end 14A of the second barrel 14 so that the ramps 48 are arranged between the longitudinal edges 44 of the slots 42 of the first barrel 12.

The longitudinal edges 44 co-operate by pressing against the ramps 48 during the movement of inserting the first barrel 12 into the second barrel 14. The annular ribs 46 deform and are forced past the annular beads 56 of the second barrel 14. The annular ribs 46 are then received in the annular grooves 54 such that the annular ribs 46 co-operate by engaging with the annular grooves 54 so as to block the first barrel 12 relative to the second barrel 14 in the longitudinal direction L.

The annular ribs 46 and the annular grooves 54 thus form a device for blocking the first barrel 12 relative to the second barrel 14 in the longitudinal direction L.

Furthermore, at the end of insertion, since the maximum space E1 between the two ramps 48 is greater than a maximum space E2 between the two longitudinal edges 44 of the slot 42 prior to assembling the two barrels 12 and 14 together, these spaces being measured in the circumferential direction C, the ramps 48 move the longitudinal edges 44 of the slot 42 apart in the circumferential direction C, whereby the annular ribs 46 are locked in position inside the respective annular grooves 54.

Specifically, since the longitudinal edges 44 of the slot 42 are spaced apart from each other in the circumferential direction C, the annular ribs 46 carried by the outer surface 12B of the assembly end 12A of the first barrel 12 engage increasingly with the annular grooves 54 of the second barrel, thereby locking the blocking device.

The longitudinal edges 44 of the slot 42 and the ramps 48 thus form a device for locking the blocking device.

It can be understood that the annular ribs 46 are blocked in the annular grooves 54.

Thus, the blocking device is deformed in the circumferential direction by the locking device.

In addition, since the maximum thickness e1 in the radial direction R of the ramps 48 is greater than the thickness e2 of the radial direction R of the assembly end 12A of the first barrel 12, the ramps 48 are stiffer than the longitudinal edges 44, so that it is the longitudinal edges 44 that deform preferentially in the circumferential direction C. Nevertheless, the longitudinal edges 44 can exert a force on each ramp 48 that is directed in the circumferential direction C, thereby tending to move the ramps 48 towards each other.

Furthermore, since the minimum thickness e3 in the radial direction R of the ramps 48 is greater than the thickness e2 in the radial direction R of the assembly end 12A of the first barrel 12, the longitudinal edges 44 also co-operate by pressing against the ramps 48 during the movement of inserting the first barrel 12 into the second barrel 14 in the zones of the ramps 48 that are not facing the window 50.

The blocking device and the locking device form a self-blocking assembly system for assembling the first barrel 12 to the second barrel 14.

The movement of assembling the two barrels 12 and 14 together is thus the first barrel 12 moving in translation relative to the second barrel 14, thereby blocking the two barrels 12 and 14 relative to each other, and then locking the blocking device at the end of assembly. This is thus a single movement of the first barrel 12 relative to the second barrel 14. The blocking device is thus locked at the end of the movement of the first barrel 12 relative to the second barrel 14 in a continuous movement of the first barrel 12 relative to the second barrel 14.

Furthermore, the rod 40 of the side button 20 can slide in the window 50 having the guide surfaces 52 that enable the movement in translation of the side button 20 to be guided in the longitudinal direction L. Since the rod 40 is received in the window 50, it can be understood that the side button 40 is received in part in the window 50.

Although the present disclosure is described with reference to a specific embodiment, it is clear that various modifications and changes may be undertaken thereon without going beyond the general ambit of the invention as defined by the claims. In addition, individual characteristics of the various embodiments mentioned may be combined in additional embodiments. Consequently, the description and the drawings should be considered in a sense that is illustrative rather than restrictive.

It can be understood that the longitudinal edges 44 of the slot 42 need not be strictly parallel to the longitudinal direction L, by way of example each of them may form an angle that is less than or equal to 1° relative to this longitudinal direction.

It can also be understood that the rib(s) may be carried by the second barrel and the groove(s) may be formed in the first barrel.

The blocking device and/or locking device as described in the embodiment of FIGS. 1 to 8 are not limiting.

What is claimed:

1. A writing instrument extending in a longitudinal direction and having a circumferential direction and a radial direction, the writing instrument comprising: a first barrel, a second barrel, and a self-blocking assembly system for assembling together the first barrel and the second barrel, the self-blocking assembly system comprising a blocking device for blocking the first barrel relative to the second barrel in the longitudinal direction and a locking device for locking the blocking device, the locking device comprising a slot arranged in the first barrel and two ramps carried by the second barrel, the slot extending in the longitudinal direction and presenting two longitudinal edges, while the two ramps are configured to move the two longitudinal edges of the slot apart progressively in the circumferential direction during assembly of the first and second barrels, the writing instrument including a window extending in the longitudinal direction and arranged between the two ramps, and also a side button received at least in part in the window, the window including guide surfaces for guiding the side button.

2. A writing instrument according to claim 1, wherein the blocking device is deformed in the circumferential direction by the locking device.

3. A writing instrument according to claim 1, wherein the blocking device comprises at least one annular rib carried by the first barrel and at least one annular groove formed in the second barrel, or vice versa, the annular rib and the annular groove co-operating by engaging one in the other.

4. A writing instrument according to claim 3, wherein the two ramps are configured to move the two longitudinal edges of the slot apart progressively in the circumferential direction while the first and second barrels, are being assembled together, whereby the annular rib is locked in position inside the annular groove.

5. A writing instrument according to claim 1, wherein a maximum thickness in the radial direction of the two ramps is greater than a thickness in the radial direction of an assembly end of the first barrel for assembly with the second barrel.

6. A writing instrument according to claim 1, wherein the first barrel is partially received in the second barrel and wherein the two ramps project in the radial direction into an inside of the second barrel and are arranged between the two longitudinal edges of the slot so as to move the two longitudinal edges of the slot apart in the circumferential direction.

* * * * *